US008398321B2

(12) United States Patent
Hautvast

(10) Patent No.: US 8,398,321 B2
(45) Date of Patent: Mar. 19, 2013

(54) METHOD AND APPARATUS FOR OPERATING A PRINTER

(75) Inventor: Heinz-Josef Hautvast, Brigachtal (DE)

(73) Assignee: Continental Automotive GmbH, Hannover (DE)

( * ) Notice: Subject to any disclaimer, the term of this patent is extended or adjusted under 35 U.S.C. 154(b) by 699 days.

(21) Appl. No.: 12/308,975

(22) PCT Filed: Jun. 19, 2007

(86) PCT No.: PCT/EP2007/056083

§ 371 (c)(1),
(2), (4) Date: Dec. 29, 2008

(87) PCT Pub. No.: WO2008/000659

PCT Pub. Date: Jan. 3, 2008

(65) Prior Publication Data

US 2009/0324313 A1 Dec. 31, 2009

(30) Foreign Application Priority Data

Jun. 29, 2006 (DE) ..... 10 2006 029 988

(51) Int. Cl.
*B41J 11/20* (2006.01)

(52) U.S. Cl. ..... 400/57

(58) Field of Classification Search ..... 400/613, 400/57; 347/19, 23, 24, 27
See application file for complete search history.

(56) References Cited

U.S. PATENT DOCUMENTS

| | | | | |
|---|---|---|---|---|
| 6,661,979 | B2 * | 12/2003 | Barlow | 399/23 |
| 6,761,427 | B1 * | 7/2004 | Owen et al. | 347/19 |
| 7,748,918 | B2 * | 7/2010 | Harris | 400/613 |
| 2002/0135628 | A1 | 9/2002 | Kolodziej | |
| 2002/0197091 | A1 | 12/2002 | Otsuki | |
| 2006/0169826 | A1 | 8/2006 | Benvenuti et al. | |
| 2009/0324313 | A1 | 12/2009 | Hautvast | |

FOREIGN PATENT DOCUMENTS

| | | | |
|---|---|---|---|
| EP | 1 323 654 | A1 | 7/2003 |
| EP | 1323654 | A1 | 7/2003 |
| JP | 63316842 | A | 12/1988 |
| JP | 5345464 | A | 12/1993 |
| JP | 6021940 | A | 1/1994 |
| JP | 2005169918 | A | 6/2005 |
| RU | 2167065 | C2 | 5/2001 |
| WO | WO 2004/080869 | A2 | 9/2004 |
| WO | WO 2008/000659 | A1 | 1/2008 |

* cited by examiner

*Primary Examiner* — Seung Lee
*Assistant Examiner* — Christle Marshall
(74) *Attorney, Agent, or Firm* — Cozen O'Connor

(57) ABSTRACT

A system and apparatus for printing configured to estimate a value of a required feed length for an intended printing operation. The printing operation is performed as a function of a comparison between the sum of an actual value of a previously consumed feed length of the print media unit and the estimated value of the required feed length for the intended printing operation at a predefined maximum feed length of the print media unit. In the event the printing operation is executed, the previously consumed feed length us updated as a function of the estimated value of the required feed length.

9 Claims, 3 Drawing Sheets

METHOD AND APPARATUS FOR OPERATING A PRINTER

PRIORITY CLAIM

This is a U.S. national stage of application No. PCT/EP2007/056083, filed on 19 Jun. 2007, which claims Priority to the German Application No.: 10 2006 029 988.4, filed: 29 Jun. 2006; the content of both being incorporated here by reference.

BACKGROUND OF THE INVENTION

1. Field of the Invention

The invention relates to a method and an apparatus for operating a printer. Printers are used for a wide variety of purposes, particularly including as a documentation unit for a tachograph, specifically a digital tachograph, in particular. A digital tachograph stores all the relevant records in a black box for a prescribed period, specifically one year, and on a personal driver's card, which is in the form of a chip card, for 28 days. Thus, driving times, working hours, standby times and rest times, and also interruptions thereto and distances covered, are stored. In addition, maximum speeds within the last 24 hours are recorded. All of the data can be read digitally by control authorities or the owner of the vehicle in line with prescribed legal regulations. In addition, the vehicle driver can print a paper record if required. For this purpose, the printer is provided.

2. Description of the Prior Art

The printing medium is usually paper and is usually stored in the form of a printing medium unit in the form of a roll in a receptacle in the printer. To date, the imminent depletion of the printing medium has been indicated to the user by an edge stripe identified by an appropriate color at the end of the printing medium.

EP 1 323 654 A1 discloses a system for detecting a low paper condition for a printer paper supply, which comprises a signal emitter for emitting a signal into a paper supply and a variably activated receiver for generating a paper supply signal, the variably activated receiver being arranged at a location for selectively receiving the signal emitted by the signal emitter in relation to the level of the paper in the supply, wherein the signal emitter is an infrared source.

SUMMARY OF THE INVENTION

It is the an object of the invention to provide a method and an apparatus for operating a printer which are simple and also convenient.

The object is achieved by the features of the independent patent claims. Advantageous refinements of the invention are identified in the subclaims.

In line with a first aspect, the invention is distinguished by a method and an appropriate apparatus for operating a printer which has a computer unit for controlling the printer, a printing medium unit comprising a printing medium and a drive unit for advancing the printing medium. An estimate of a requisite advance length for an intended printing operation is prescribed. This estimate may be prescribed by another logical functional unit, for example on the basis of the number of characters to be printed or the number of lines or the like. The printing operation is executed on the basis of a comparison of the sum of an actual value of an advance length already depleted beforehand from the printing medium unit, specifically for preceding printing operations with the same printing medium unit, and the estimate of the requisite advance length for the intended printing operation with a prescribed maximum advance length of the printing medium unit. The advance length already depleted beforehand is updated on the basis of the estimate of the requisite advance length when the printing operation is executed. In this way, it is a simple matter to automatically decide about the actual performance of the printing operation, and hence the printing medium available on the printing medium unit can be used up largely completely without the risk of the respective printing operation not being able to be performed completely on account of a lack of further printing medium.

In line with a second aspect, the invention is distinguished by a method and an appropriate apparatus for operating the printer in accordance with the first aspect, wherein an estimate of a requisite advance length for an intended printing operation is prescribed. The printing operation is performed on the basis of a comparison of the difference between an actual value of an advance length still remaining on the printing medium unit and the estimate of the requisite advance length for the intended printing operation with a prescribed minimum advance length of the printing medium unit. The advance length still remaining is updated on the basis of the estimate of the requisite advance length when the printing operation is executed. The advantages of the first aspect of the invention correspond accordingly to those of the second aspect.

In line with one advantageous refinement of the first aspect of the invention, a signal is sent to an output unit if the sum of the actual value of the advance length already depleted beforehand from the printing medium unit and the estimate of the requisite advance length for the intended printing operation exceeds the maximum advance length of the printing medium unit. This provides a simple way of indicating to the user of the printer that there is no longer sufficient printing medium available, specifically using appropriate audio or visual indicators using the output unit.

In line with a corresponding advantageous refinement of the second aspect, the signal is sent to the output unit if the difference between the actual value of the advance length still remaining on the printing medium unit and the estimate of the requisite advance length for the intended printing operation is less than the prescribed minimum advance length of the printing medium unit. The advantages correspond accordingly to one another.

In line with another advantageous refinement of the first aspect, the remaining printing medium on the printing medium unit is ejected from the printer if the sum of the actual value of the advance length already depleted beforehand from the printing medium unit and the estimate of the requisite advance length for the intended printing operation exceeds the prescribed maximum advance length of the printing medium unit. It is thus a particularly convenient matter to automatically remove the printing medium unit from the printer when there is no longer sufficient printing medium available, without user intervention.

In line with another advantageous refinement of the second aspect, the printing medium unit is ejected from the printer if the difference between the actual value of the advance length still remaining on the printing medium unit and the estimate of the requisite advance length for the intended printing operation is less than the prescribed minimum advance length of the printing medium unit. This also allows simple and convenient removal of the printing medium unit from the printer automatically when there is no longer sufficient printing medium available.

In line with another advantageous refinement either of the first or of the second aspect, the drive unit comprises a stepping motor. During operation of the printer with one and the same printing medium unit, the steps of the stepping motor up to and including ejection of the printing medium unit are summed to form a summed step value. The summed step value can then be taken as a basis for determining an end length of the printing medium unit which is representative of the total length of the printing medium which has been advanced for all printing operations, including ejection of the remaining printing medium. In this way, it is thus possible to ascertain the actual length of printing medium which can be attributed to the respective printing medium unit with particular precision. This can then be used to adapt, by way of example, the maximum advance length of the printing medium unit or the actual value of the advance length still remaining on the printing medium unit, particularly when initialization needs to be performed after a new printing medium unit has been inserted.

In this connection, it is particularly advantageous if a filtered end length value is ascertained by virtue of prescribed filtering of a plurality of end lengths associated with various medium units. In this case, the filtering is performed preferably in the sense of averaging, for example in the form of sliding averaging or the like. This means that the end length to be expected with a high level of probability regardless of the individual printing medium unit can be ascertained particularly well.

BRIEF DESCRIPTION OF THE DRAWINGS

Exemplary embodiments of the invention are explained in more detail below with reference to the schematic drawings, in which.

Elements having the same design or function are identified by the same reference symbols throughout the figures.

DETAILED DESCRIPTION OF THE PRESENTLY PREFERRED EMBODIMENTS

Figure 1:
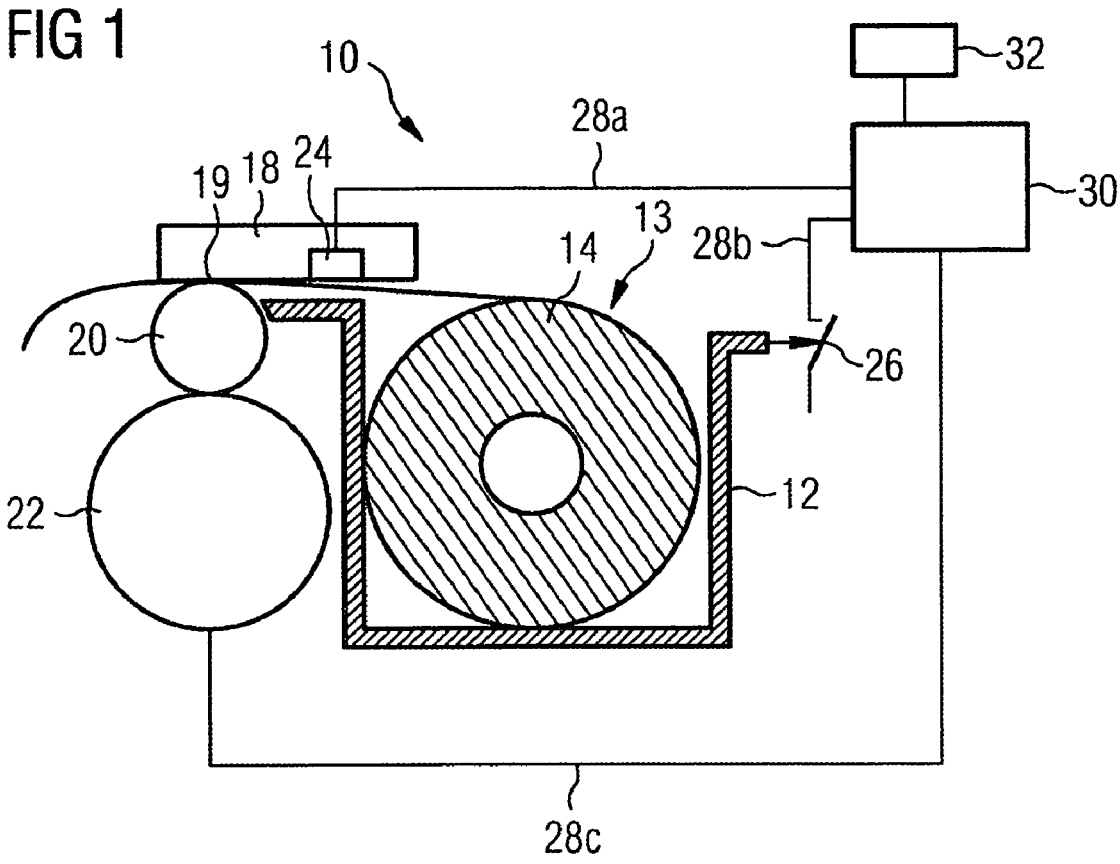
FIG. 1 shows a printer.

A printer 10 (FIG. 1) has a receptacle 12 which can be used to store a printing medium unit 13. The printing medium unit 13 comprises a printing medium 14, which is preferably wound in roll form. Preferably, the printing medium 14 is paper. In addition, a print head 18 is provided which is used to print the printing medium 14. In addition, a passage position 19 of the printing medium 14 is provided. A transport roller 20 transports the printing medium 14 and therefore advances the printing medium 14. The transport roller 20 is part of a drive unit, which is preferably driven by means of a motor, which is preferably in the form of an electric stepping motor 22. In addition, a printing medium sensor 24 is preferably provided which can be used to detect whether the printing medium 14 is being supplied to the print head 18. Furthermore, a receptacle sensor 26 is preferably provided which can be used to identify whether the receptacle 12 is in an open or closed state. In addition, signal lines 28*a*, 28*b*, 28*c* are provided which provide electrically conductive coupling between the sensors and a computer unit 30.

The computer unit 30 can also undertake control tasks and thus actuate the stepping motor, for example. The computer unit also contains a memory, particularly a data program store. Furthermore, the computer unit 30 has an associated output unit 32, which may be a visual or else audio output unit, for example.

Figure 2:
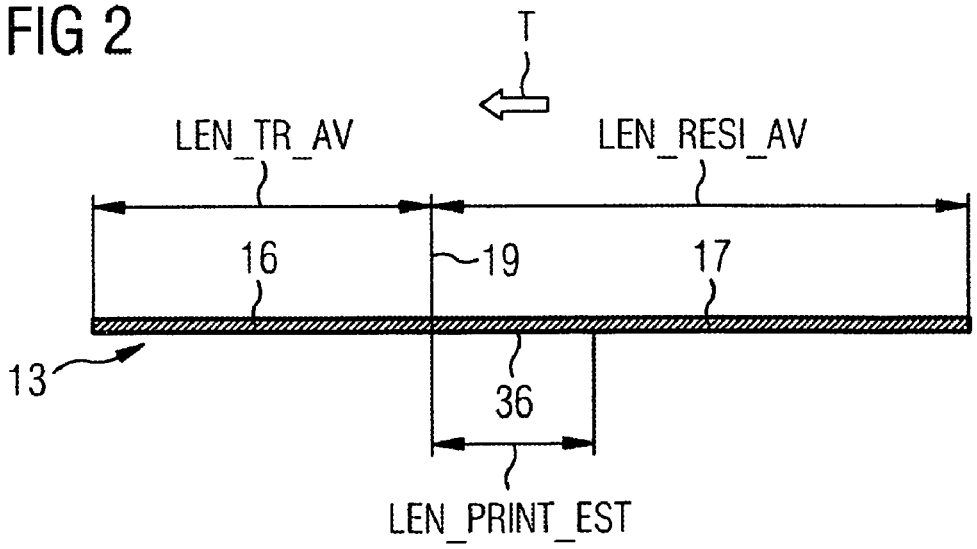
FIG. 2 shows a printing medium.

FIG. 2 shows the printing medium 14 from the printing medium unit 13 in the rolled-out state in order to provide a more detailed explanation of further terms. In this case, the passage position 19 represents the reference at which, at present, in accordance with FIG. 1, the printing medium is pressed against the print head 18 in the region of the transport roller 20 for the purpose of advancing and printing it. LEN_TR_AV denotes an actual value of an advance length already depleted beforehand from the printing medium unit. In addition, T denotes the direction of transport and hence the direction of advance of the printing medium 14. LEN_RESI_AV denotes an actual value of an advance length still remaining on the printing medium unit. The advance length of the printing medium unit 13 is self-evidently representative of the advance length of the printing medium 14 on the printing medium unit 13. LEN_PRINT_EST denotes an estimate of the requisite advance length for the intended printing operation.

Figure 3:
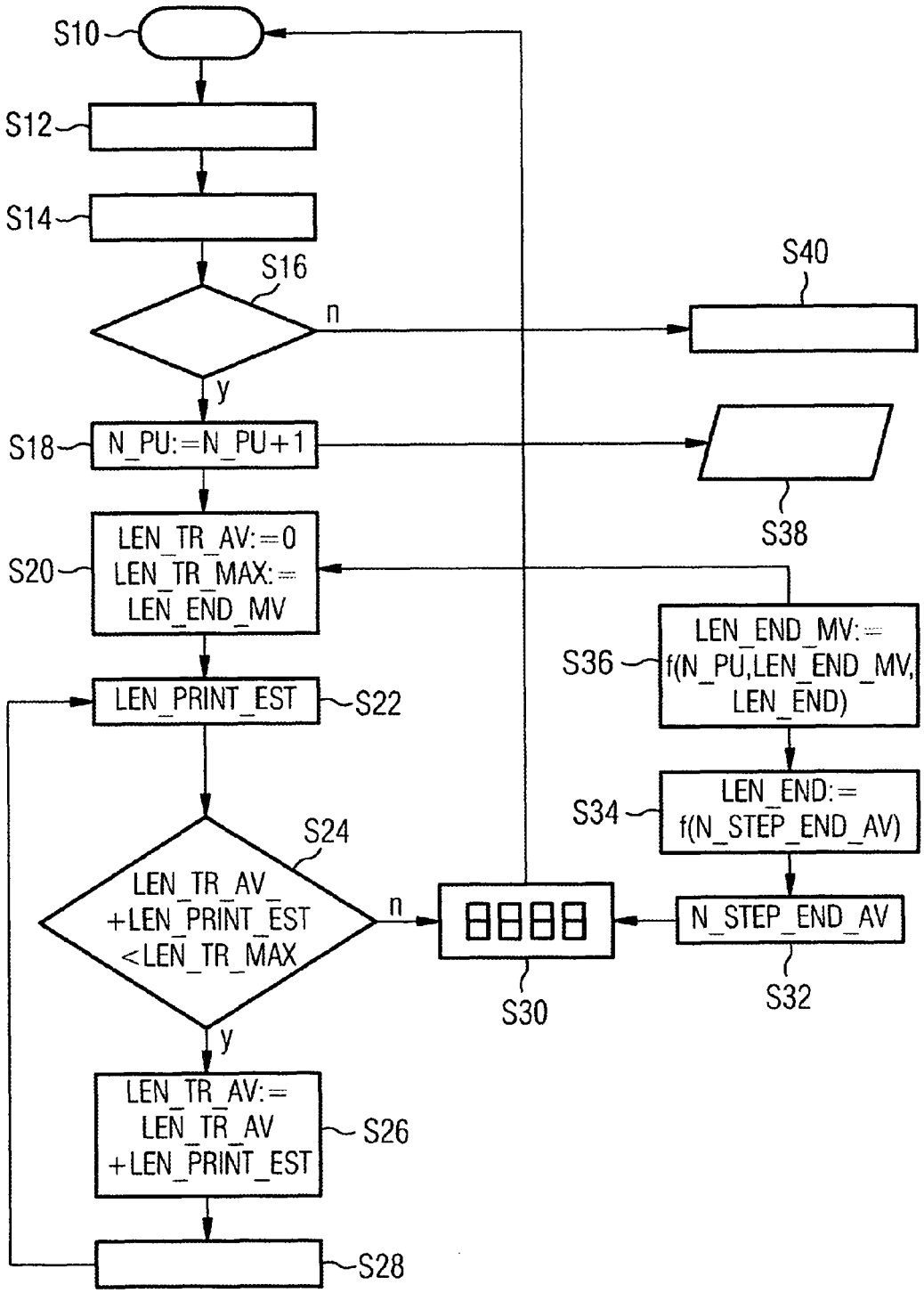
FIG. 3 shows a flowchart of a program which can be executed in a computer unit of the printer.

A flowchart of a first program, which is stored in the program store of the computer unit and is executed during operation of the printer, in the computer unit 30 is explained in more detail below with reference to FIG. 3.

In a step S10, the program is started, specifically preferably in connection with the receptacle sensor 26 sensing that the receptacle 12 is open.

In a step S12, it is then identified that a new printing medium unit 13 has been placed into the receptacle 12. This is done by means of the printing medium sensor 24, for example.

In a step S14, a check is then performed to determine whether the receptacle 12 is subsequently locked, specifically by checking the measurement signal from the receptacle sensor 26 as appropriate.

In a subsequent step S16, a check is then performed to identify whether a complete printing medium unit 13 has been placed into the receptacle 12. If this is not the case, preferably the output unit 32 provides an indication, in a step S40, that the subsequent functionality of the printer is therefore not supported, and the program is terminated and is preferably restarted in step S10 after a prescribed waiting period, particularly when it is sensed that the receptacle 12 is unlocked.

If the condition in step S16 is met, however, a flag N_PU for the number of printing medium units 13 is preferably incremented by one in a step S18. The flag N_PU is preferably stored in the data store of the computer unit 30 and can be read during a maintenance service or the like, for example, and can then also be compared for the purpose of aligning printing medium units 13 actually sold by the service provider of the maintenance service, for example. In this way, it is possible to identify, by way of example, if printing medium units 13 which do not meet appropriate maintenance agreement conditions have been used in the printer.

In a step S20, the actual value LEN_TR_AV of an advance length already depleted beforehand from the printing medium unit 13 is then initialized, specifically preferably with the value zero. Furthermore, the maximum advance length LEN_TR_MAX of the printing medium unit 13 is prescribed in step S20. In one particularly simple refinement of the program, this may be a firmly prescribed value which is stored in the data store of the computer unit 30. Preferably, however, the maximum advance length LEN_TR_MAX of the printing medium unit is prescribed in step S20 on the basis of an end length LEN_END, specifically with particular preference on the basis of an end length mean value LEN_END_MV, both of which are explained in more detail further below. It is a particularly simple matter for the end length mean value LEN_END_MV to be directly assigned to the maximum advance length LEN_TR_MAX of the printing medium unit 13 in step S20.

In a step S22, an estimate LEN_PRINT_EST of the requisite advance length for an intended printing operation is prescribed. This is preferably done by means of an appropriate function which is executed in the computer unit 30, preferably in the form of a further program, and which uses the data, characters or graphical symbols or the like to be printed to calculate and hence estimate the estimate LEN_PRINT_EST of the requisite advance length for the intended printing operation.

In a step S24, a check is then performed to determine whether the sum of the actual value LEN_TR_AV of the advance length already depleted beforehand from the printing medium unit 13 and the estimate LEN_PRINT_EST of the requisite advance length for the intended printing operation is less than the prescribed maximum advance length LEN_TR_MAX of the printing medium unit 13.

If this is the case, the actual value LEN_TR_AV of the advance length already depleted beforehand from the printing medium unit 13 is increased by the estimate LEN_PRINT_EST of the requisite advance length for the intended printing operation, specifically in a step S26. In a step S28, the printing operation is then preferably performed as appropriate by virtue of appropriate operation of the stepping motor 22, which is part of the drive unit, and hence advancing of the printing medium and application of the print to the printing medium 4 by actuating the print head 18.

Next, the processing is then continued in a step S22, the program preferably remaining in step S22 until the aforementioned function in the computer unit prescribes the estimate LEN_PRINT_EST of the requisite advance length for a further intended printing operation again.

If the condition in step S24 is not met, on the other hand, preferably the output unit 32 signals, in a step S30, that there is no longer sufficient printing medium 14 available. This can be done by means of visual or else audio signaling, as appropriate.

Preferably, the printing medium 14 on the printing medium unit 13 is then advanced further until the printing medium 14 on the current printing medium unit 13 is completely depleted. In principle, preferably whenever the stepping motor 22 is actuated for the current printing medium unit 13, a summed step value N_STEP_END_AV is incremented according to the number of steps of the stepping motor 22 which are performed and actuated. Hence, the summed step value N_STEP_END_AV is also incremented as appropriate during the performance of step S32 until the printing medium 14 is depleted as far as possible. This can be sensed on the basis of the measurement signal from the printing medium sensor 24, for example.

Next, in a step S34, an end length LEN_END is ascertained on the basis of the then valid value of the summed step value N_STEP_END_AV. In this case, it is then possible to take the known step angle of a step of the stepping motor and the known translation of the step angle by means of the transport roller into a corresponding translational movement of the printing movement 14, for example, as a basis for ascertaining the end length.

In a step S36, the end lengths LEN_END ascertained for various printing medium units and produced during a plurality of successive passes of step S34 are preferably filtered. This is preferably done within the context of averaging the end lengths. To this end, it is a particularly simple matter to ascertain a sliding average, for example.

Alternatively, however, a detected number N_PU of the depleted printing medium units 13 and the respective values of the end lengths LEN_END of these depleted printing medium units 13 can also be taken as a basis for ascertaining. Next, the maximum advance length LEN_TR_MAX can then be calculated in step S20 on the basis of the current value of the end length mean value LEN_END_MV. However, the processing is preferably continued subsequently to step S36 in one of steps S10 to S18.

Figure 4:
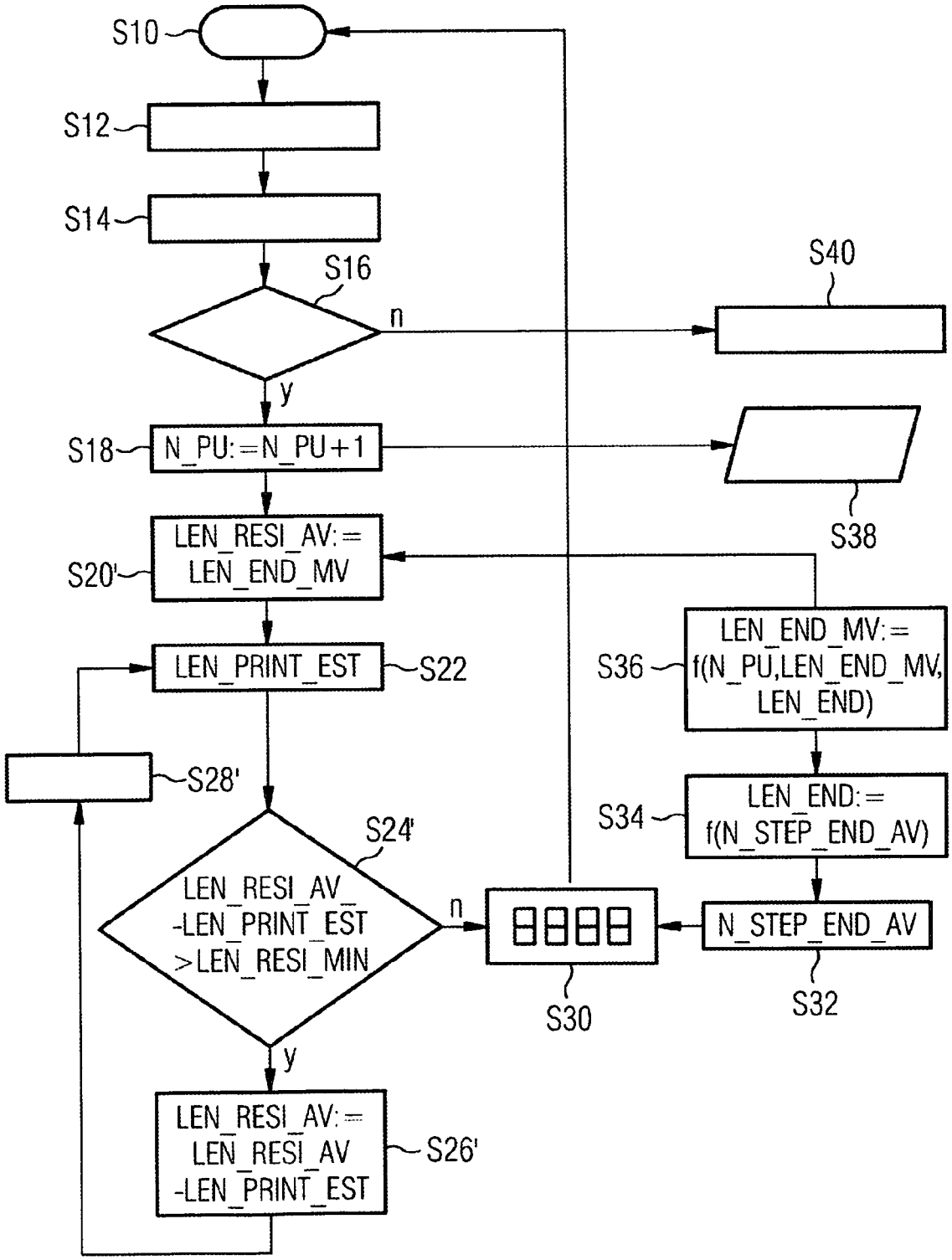
FIG. 4 shows a further flowchart of a further program, which can be executed in the computer unit of the printer.

A further program is explained in more detail below with reference to the flowchart in FIG. 4, only the differences from the one shown in FIG. 3 being discussed in more detail. In a step S20', an actual value LEN_RESI_AV of an advance length still remaining on the printing medium unit is ascertained on the basis of preferably the end length mean value LEN_END_MV, specifically preferably by means of direct association. Alternatively, it can also be ascertained on the basis of just the end length LEN_END, however.

In a step S24', a check is performed to determine whether the difference between the actual value LEN_RESI_AV of the advance length still remaining on the printing medium unit 13 and the estimate LEN_PRINT_EST of the requisite advance length for the intended printing operation is greater than a prescribed minimum advance length LEN_RESI_MIN of the printing medium unit.

If the condition in step S24' is met, the actual value LEN_RESI_AV of the advance length still remaining on the printing medium unit 13 is reduced in a step S26' by the estimate LEN_PRINT_EST of the requisite advance length for the intended printing operation. Next, the printing operation is preferably performed in step S28'. Next, the processing is then continued in step S22 in accordance with the program shown in FIG. 3.

This therefore allows standard deviations in the end length LEN_END of the printing medium 14 to be taken into account and hence optimum utilization of printing medium to be achieved.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method for operating a printer, the printer comprising:

a computer unit configured to control the printer;

a printing medium unit comprising a roll of printing medium coupled to the computer; and a drive unit configured to advancing the roll of printing medium, the method comprising:

estimating a length of the printing medium for an intended printing operation;

executing the printing operation based at least in part on a comparison of an actual value of a length of the printing medium already depleted from the roll of printing medium and the estimate of the length for the intended printing operation with a maximum advance length of the printing medium;

updating the value of the length of the printing medium already depleted from the roll of printing medium based on the estimate of the length of the roll of printing medium for an intended printing operation when the printing operation in said step of executing is executed; and ejecting a remaining unprinted printing medium from the printer when the sum of the actual value of a length of the printing medium already depleted from the roll of printing medium and the estimate of the length for the intended printing operation exceeds the maximum advance length of the printing medium unit of the roll of printing medium.

2. The method according to claim 1, further comprising sending a signal to an output unit of the printer when the sum of the actual value of a length of the printing medium already depleted from the roll of printing medium and the estimate of the length for the intended printing operation exceeds the maximum advance length of the printing medium of the printing medium unit.

3. The method according to claim 1, wherein the drive unit comprises a stepping motor, the method further comprising:

summing steps of the stepping motor up to and including ejection of said printing medium during operation of the printer, to form a summed step value; and determining an end length of the roll of printing medium based in part on the summed step value.

4. The method as claimed in claim 3, further comprising determining a filtered end length mean value by filtering of a plurality of end lengths associated with various printing medium units.

5. A method for operating a printer, wherein the printer comprises:

a computer unit for controlling the printer;

a printing medium unit comprising a roll of printing medium coupled to the computer; and a drive unit for advancing the roll of printing medium, the method comprising:

setting an estimate of a required advance length for an intended printed operation;

executing the printing operation base on a comparison of the difference between an actual value of an advance length on the roll of printing medium and the estimate of the required advance length for the intended printing operation with a prescribed minimum advance length of the printing medium unit;

updating the advance length remaining on the roll of printing medium based on the estimate of the required advance length when the printing operation is executed; and ejecting a remaining unused printing medium on the roll of printing medium from the printer when the difference between the actual value of the advance length on the roll of printing medium and the estimate of the required advance length for the intended printing operation is less than the prescribed minimum advance length of the roll of printing medium.

6. The method according to claim 5, further comprising sending a signal to an output unit coupled to the computer unit when a difference between the actual value of the advance length on the roll of printing medium and the estimate of the required advance length for the intended printing operation is less than the prescribed minimum advance length of the roll of printing medium.

7. The method as claimed in claim 5, wherein the drive unit comprises a stepping motor, the method further comprising:

summing steps of the stepping motor up to and including ejection of said roll of printing medium during operation of the printer, to form a summed step value; and determining an end length of the roll of printing medium unit based in part on the summed step value.

8. An apparatus for operating a printer, comprising:

a computer unit for controlling the printer;

a printing medium unit comprising a roll of printing medium for printing by the printer; and a drive unit for advancing the roll of printing medium;

wherein the apparatus is configured to:

set an estimate of a required advance length for an intended printing operation;

execute the printing operation based on a comparison of a sum of an actual value of an advance length already depleted from the roll of printing medium and the estimate of the required advance length for the intended printing operation with a set maximum advance length of the roll of printing medium;

update the advance length already depleted from the roll of printing medium based on the estimate of the requisite advance length when the printing operation is executed; and eject a remaining unused printing medium on the roll of printing medium from the printer when the sum of the actual value of the advance length already depleted from the roll of printing medium and the estimate of the required advance length for the intended printing operation is greater than the set maximum advance length of the roll of printing medium.

9. An apparatus for operating a printer, the printer comprising:

a computer unit for controlling the printer;

a printing medium unit comprising a roll of printing medium for the printer; and a drive unit for advancing the roll of printing medium;

wherein the apparatus is configured to:

set an estimate of a required advance length for an intended printing operation;

execute the printing operation based on a comparison of the difference between an actual value of an advance length remaining on the roll of printing medium and the estimate of the required advance length for the intended printing operation with a preset minimum advance length of the roll of printing medium;

update the advance length remaining based on the estimate of the requisite advance length when the printing operation is executed; and eject a remaining unused printing medium on the roll of printing medium from the printer when the difference between the actual value of the advance length on the roll of printing medium and the estimate of the required advance length for the intended printing operation is less than the prescribed minimum advance length of the roll of printing medium.

* * * * *